US007857172B2

(12) United States Patent
Harvey

(10) Patent No.: US 7,857,172 B2
(45) Date of Patent: Dec. 28, 2010

(54) PUMP MOUNTABLE ON TWO SIZES OF CONTAINER

(75) Inventor: Joshua N. Harvey, Renton, WA (US)

(73) Assignee: Wilmar Corporation, Renton, WA (US)

( * ) Notice: Subject to any disclaimer, the term of this patent is extended or adjusted under 35 U.S.C. 154(b) by 453 days.

(21) Appl. No.: 12/157,279

(22) Filed: Jun. 9, 2008

(65) Prior Publication Data

US 2009/0302066 A1 Dec. 10, 2009

(51) Int. Cl.
*B65D 88/54* (2006.01)

(52) U.S. Cl. ..... 222/321.1; 222/321.7; 222/321.9; 222/568; 215/319; 220/287

(58) Field of Classification Search ..... 222/321.1, 222/568, 321.7, 562, 321.9, 385, 383.1; 215/319; 220/287–288
See application file for complete search history.

(56) References Cited

U.S. PATENT DOCUMENTS 3,467,270 A 9/1969 Eady
3,850,341 A * 11/1974 Bart ..... 220/212
4,286,736 A * 9/1981 Corsette ..... 222/153.13
4,444,358 A 4/1984 Spohn
4,511,065 A * 4/1985 Corsette ..... 222/153.13
5,295,601 A * 3/1994 Bostelman ..... 220/287
5,676,314 A 10/1997 Brass
5,695,086 A * 12/1997 Viola ..... 220/287
5,810,212 A * 9/1998 Santagiuliana ..... 222/546
5,816,447 A 10/1998 Shanklin
5,960,998 A * 10/1999 Brown ..... 222/131
6,006,949 A * 12/1999 Foster et al. ..... 222/153.13
6,296,154 B1 10/2001 Shanklin
6,390,315 B1 * 5/2002 Giddings et al. ..... 215/235
6,875,204 B1 4/2005 Hopkins
6,877,626 B2 * 4/2005 Sherrod ..... 215/319
6,953,133 B2 10/2005 Englhard
7,111,762 B2 * 9/2006 Saunders et al. ..... 222/382
7,134,577 B1 * 11/2006 Verma ..... 222/321.9
7,198,178 B2 4/2007 Shanklin
2006/0273092 A1 * 12/2006 Nottingham et al. ..... 220/701

* cited by examiner

*Primary Examiner*—Frederick C. Nicolas
(74) *Attorney, Agent, or Firm*—Christensen O'Connor Johnson Kindness PLLC

(57) ABSTRACT

A cap (30) has an end wall (32) and inner and outer cylindrical walls (34, 36) which are internally threaded. The threads on the inner wall (30) mate with external threads on the neck (38) of a first sized container (40) the threads on the wall (38) are adapted to engage threads on the neck of a second, larger size container (44). A pump (10) is mounted on the cap (30).

9 Claims, 4 Drawing Sheets

PUMP MOUNTABLE ON TWO SIZES OF CONTAINER

TECHNICAL FIELD

This invention relates to a hand operated pump mounted onto a cap that is adapted for mounting the pump onto an externally threaded neck portion of a container. More particularly, it relates to such a pump in which the cap is adapted to selectively connect the pump to two different sizes of container.

BACKGROUND OF THE INVENTION

It is known to mount a hand operated pump onto a cap for a container. The pump includes a draw tube which extends downwardly from the cap into liquid in the container. The neck of the container has external threads and the cap has internal threads that connect to the external threads on the neck.

There is a need for a cap mounted pump that can be used equally well with two different sizes of containers e.g. a quart container and a gallon container. The principal object of the present invention to fill this need.

BRIEF SUMMARY OF THE INVENTION

The pump of the present invention comprises an elongated draw tube having a lower end portion including an inlet and an upper end portion. A piston is adapted to slide up and down in the draw tube. A piston rod is connected to the piston and projects upwardly from the piston and out from the draw tube. A valve in the lower end portion of the draw tube is adapted to close the inlet when the piston moves in one direction in the draw tube, and to open the inlet when the piston moves in the opposite direction in the draw tube. The pump is provided with a mounting cap that is adapted to connect to a threaded neck on a first container of a first size, and is also adapted to connect to a threaded neck on a second larger size container. The mounting cap has a top wall, an inner cylindrical wall extending axially downwardly from the top wall, and an outer cylindrical wall extending axially downwardly from the top wall concentrically around the inner cylindrical wall. The mounting cap is mounted on and rotatable about the draw tube. The inner cylindrical wall has internal threads for connecting the cap to external threads on the neck of the first container, with the draw tube extending downwardly into the first container. The second cylindrical wall has internal threads for connecting the cap for external threads on the neck of the second, larger container, with the draw tube extending downwardly into the second container.

In preferred form, the top wall of the mounting cap includes a central opening and the upper end portion of the draw tube extends upwardly through the central opening. There is a radial flange on the draw tube positioned below the top wall of the mounting cap where it boarders the opening in the mounting cap. There is also a retainer above the mounting cap that engages the upper end portion of the draw tube, above the cap. The retainer prevents upward movement of the mounting cap off the upper end of the draw tube.

Preferably also, the draw tube includes a piston chamber through which the piston moves as it slides up and down the draw tube. The draw tube includes a conical section above the piston chamber that increases in diameter as it extends upwardly from the piston chamber to the upper end portion of the draw tube. The radial flange extends radially outwardly from where the upper end of the conical section meets the upper end portion of the draw tube.

Preferably, the piston rod includes an outlet passageway for the pump and the pump includes a depress button connected to an upper end portion of the piston rod. The outlet passage in the piston rod communicates with a passage in the mounting cap that leads to a discharge passageway. When the depress button is depressed, the piston moves downwardly in the piston chamber and liquid in the pump above the valve is forced upwardly through the passageway in the piston rod, to and through the passageway in the depress button, and to and through the discharge passage leading from the outlet passage.

Other more detailed features of the invention are described in the description of the illustrated embodiment and are particularly pointed out in the appended claims.

BRIEF DESCRIPTION OF THE SEVERAL VIEWS OF THE DRAWINGS

Like reference numerals are used through out the several views of the drawing, and.

DETAILED DESCRIPTION OF THE ILLUSTRATED EMBODIMENT

Figure 1:
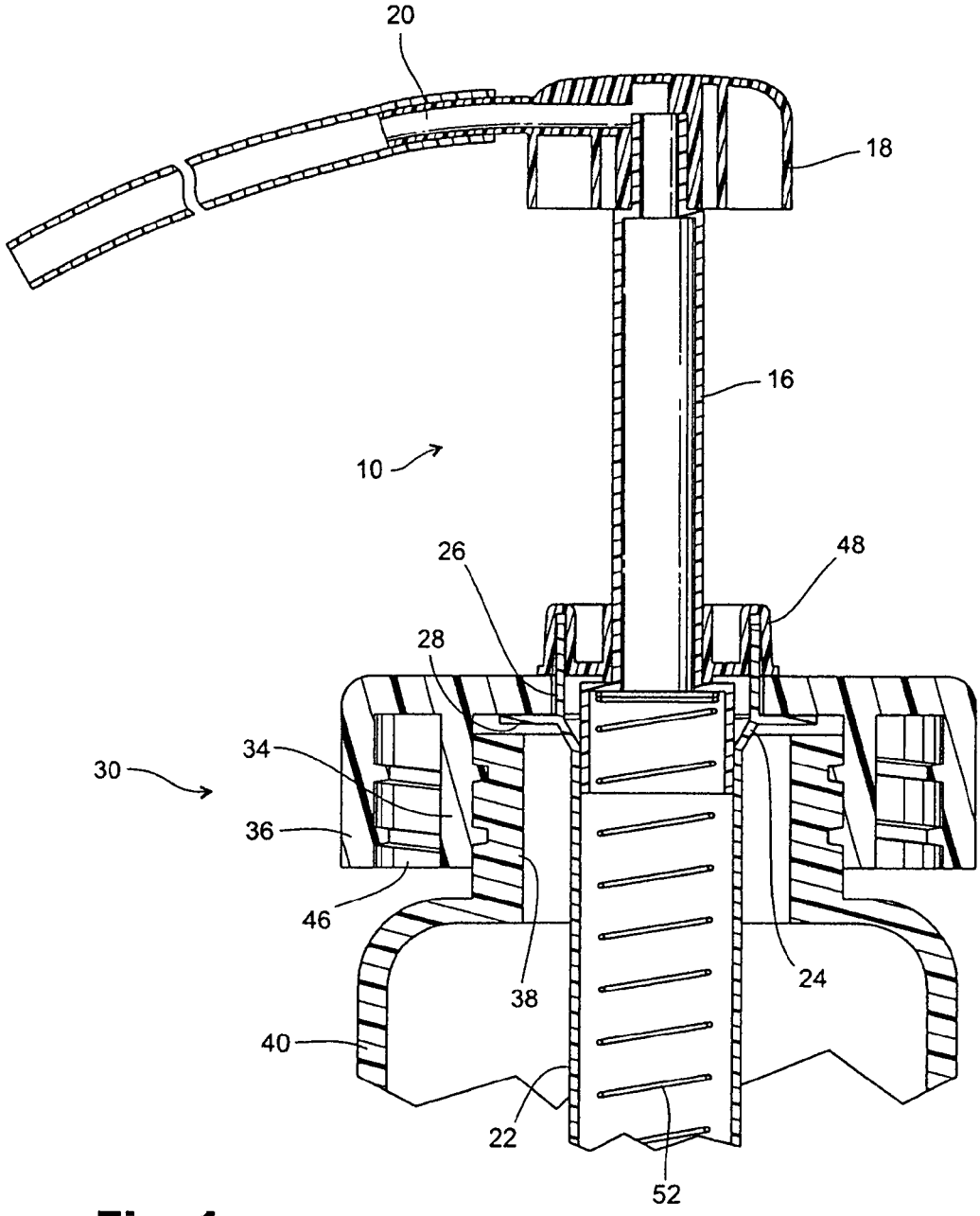
FIG. 1 is a fragmentary sectional view of an upper portion of a container onto which a cap mounted pump has been added, such view showing the cap connected to a neck portion of a first container by a first set of threads carried by a first cylindrical cap wall.

FIGS. 1-4 show a hand operated pump 10 comprising an elongated tubular draw tube 12, a piston 14 in the draw table 12, and a hollow piston rod 16 extending upwardly from the piston 14 into a depress button 18 that includes a discharged passageway 20. Draw table 12 comprises a central portion 22 having a first, substantially constant diameter. The upper end of central portion 22 is joined to a conical portion 24 having a lower end equal in diameter in the central portion 22. Portion 24 increases in diameter as it extends upwardly to a cylindrical upper end portion 26. A radial flange 28 extends radially outwardly from the intersection of the portion 24 with the upper end portion 26.

As will hereinafter be described, the draw tube 12 is connected to a mounting cap 30. Cap 30 includes a substantially flat upper end wall 32, a first cylindrical wall 34, and a second cylindrical wall 36. Walls 34, 36 are concentric. Each has an upper end that is connected to the top wall 32, and a lower end. Wall 34 has internal threads on its inner side which match and mate with external on the neck portion 38 of a first size container 40. Wall 36 has internal threads that mate with external threads on its inner side on the neck portion 42 of a second, larger size container 44. By way of typical and non-limitive example, the smaller container 40 may be a quart container and the larger container 44 may be a gallon container.

As clearly shown by FIGS. 1-4, an annular space exists between the inner and outer walls 34, 36. The top 32 of cap 30 has a center opening sized to receive the upper end portion 26 of draw tube 12. As shown by FIGS. 1-4, the end portion 26 is inserted upwardly through the center opening and the draw tube 12 is moved upwardly until the flange 28 contacts the portion of the wall 32 that immediately surrounds the center opening in the wall 32.

The piston/piston rod assembly 14, 16 is inserted downwardly, piston end first into the upper end of the draw tube 12. Once the assembly 14, 16 is in place, the cap 18 is installed and then, a retainer ring 48 is installed. It has a tubular center portion through which the piston rod 16 extends, a tubular outer portion composed of inner and outer substantially concentric walls and an annular cylindrical space between the inner and outer walls. An entrance to this space is provided at the bottom of ring 48. The tops of the inner and outer walls are connected together. A radial wall extends between the lower ends of the tubular center portion and the inner wall of the tubular outer portion. After the piston/piston rod assembly 14, 16 is installed in the draw tube 12, the connector ring 48 is inserted downwardly, with the piston rod 16 in the center opening of ring 48. Ring 48 is moved downwardly until it is on the upper end portion of the tubular upper portion 26 of the draw tube 12. The central portion of the retainer 48 serves as a bearing for the piston rod 16 as it moves up and down. There is a close enough fit between the piston rod 16 and the cylindrical surface in which it moves to provide an adequate seal, preventing unwanted leakage from the pump between the piston rod 16 and the retainer 48. The bottom wall of the retainer 48 closes the central opening in the cap 32 between the piston rod 16 and the upper end portion 26 of the draw tube 12.

Figure 3:
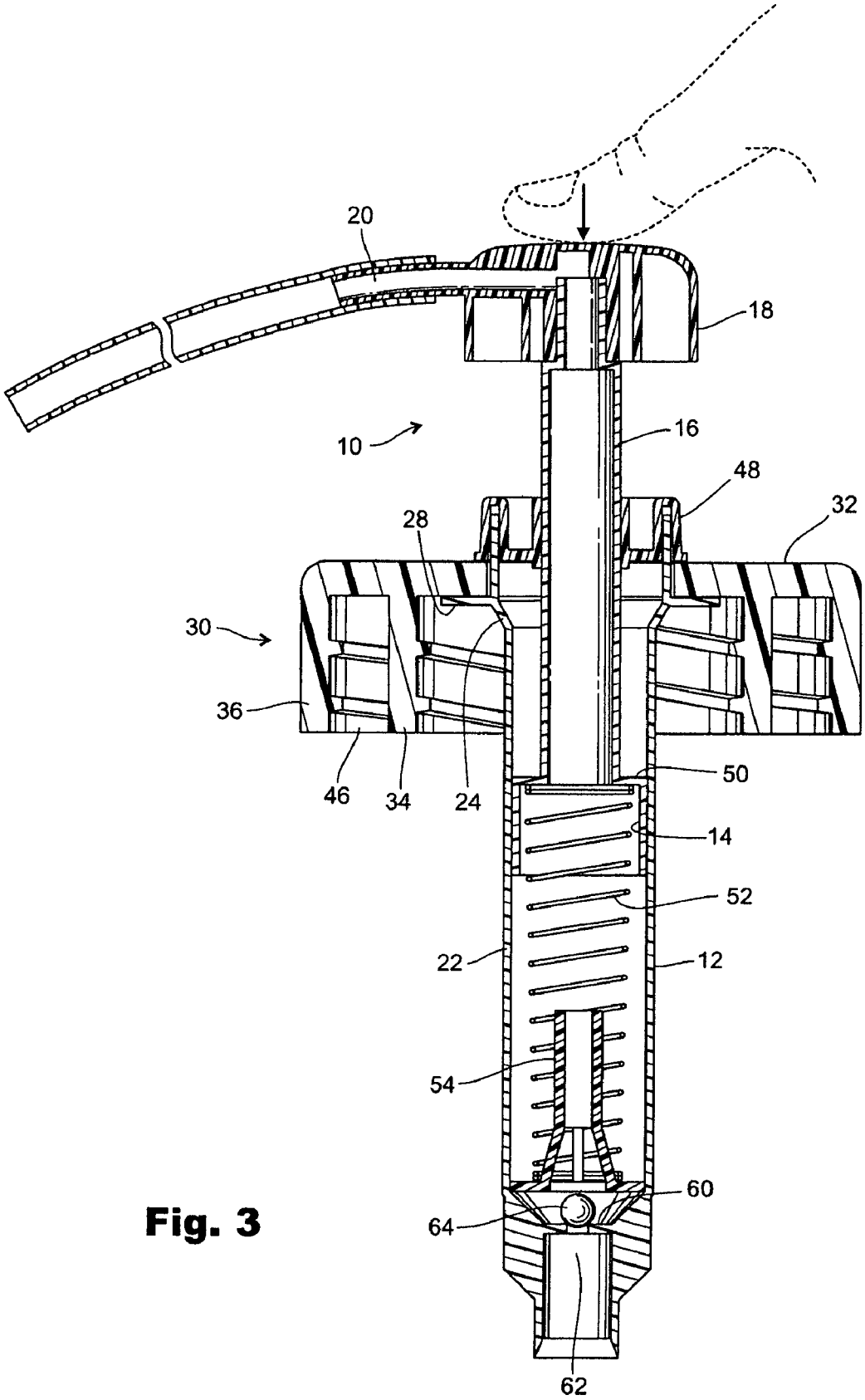
FIG. 3 is a view like FIGS. 1 and 2 but showing the full height of the pump and omitting the container, such view showing a piston portion of the pump in the process of being depressed.
Figure 4:
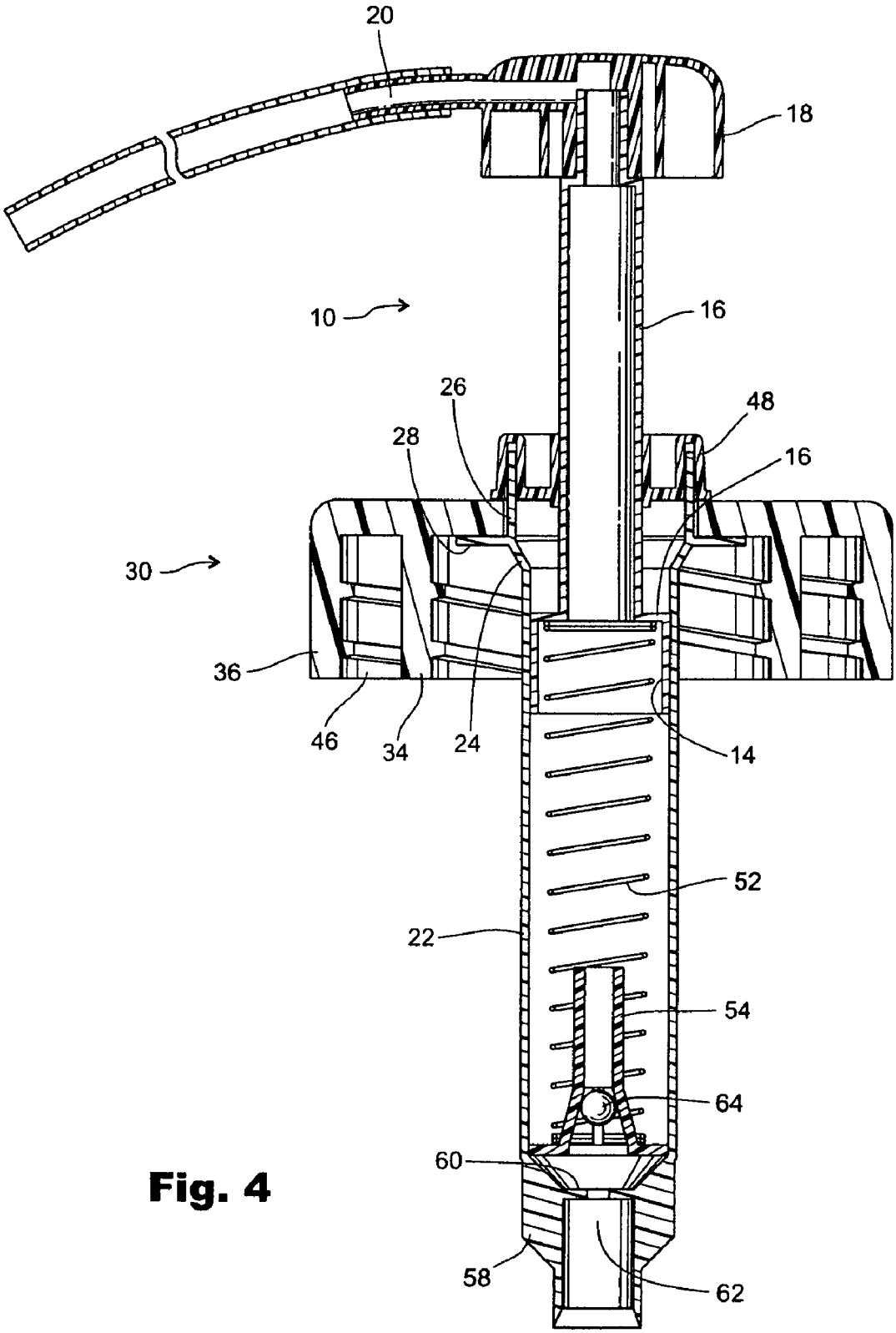
FIG. 4 is a view like FIG. 3, but showing downward pressure removed from the piston portion of the pump, and showing a return spring moving the piston upwardly into a raised position.

The piston 14 is cup-shaped and the piston rod 16 is tubular. A radial shoulder 50 is formed where the piston rod 16 joins the piston 14. A coil spring 52 is situated inside the tubular housing 12 with its upper end in contact with the shoulder 50. The lower end portion of spring 52 surrounds a tubular insert 54 having a lower end 56 which contacts the upper end portion of the valve seat 58. As shown by FIGS. 3 and 4, the spring 52 reduces in diameter as it extends downwardly around the member 54. At its lower end spring 52 makes abutting contact with the radial wall 56. Valve seat member 58 has a radial wall 60 surrounding an orifice 62. A ball 64 sits on the wall 60 and closes the orifice 62 whenever the piston 50 is moved downwardly. When the piston is moved upwardly, suction within draw tube 12 pull ball 64 off of the valve seat 62 and pulls it up into the tube 54, into the position shown by FIG. 4. The suction also, pulls liquid upwardly through the orifice 62 and then through slot opening in the side wall of tube 54, into the piston chamber.

Figure 2:
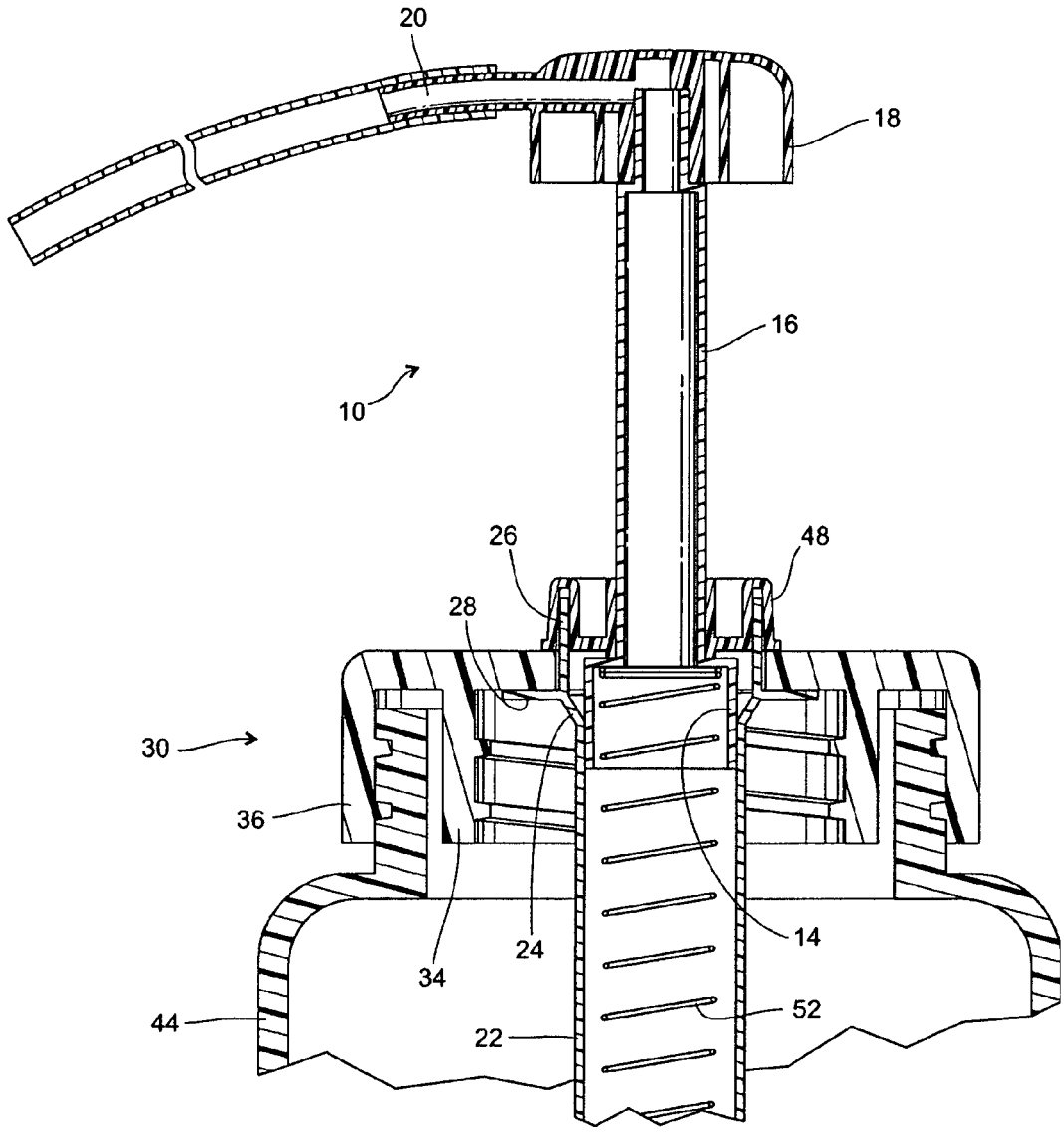
FIG. 2 is a view like FIG. 3 but showing the cap attached to a second container, having a larger diameter outlet, by a threaded connection on a second, larger cylindrical wall that surrounds the first cylindrical wall.

Referring to FIG. 1, a gap is shown vertically between container neck 38 and the top wall 32 of the cap 30. A washer may be provided in this space, to seal between the container and the cap. Or, the cap maybe adapted to be screwed down until annular member 28 meets the top of the neck 38 and it serves as a sealing washer. As shown by FIG. 2, a cap 30 is installed onto a larger container 44, the threads between the container neck 42 and the cap wall 36 are in the annular space between the two walls 34, 36. The washer maybe provided between the top of wall 42 and the top wall 32.

The illustrated embodiments are only examples of the present invention and, therefore, are non-limitive. It is to be understood that many changes in the particular structure, material and features of the invention maybe made without departing from the spirit and scope of the invention. Therefore, it is my intention that my patent rights not be limited by the particular embodiment that is illustrated and described herein, but rather is to be determined by the following claims, interpreted according to accepted doctrines of patent claim interpretation.

What is claimed is:

1. A pump, comprising:

an elongated draw tube having a lower end inlet and an upper end portion;

a piston in said draw tube adapted to slide up and down in the draw tube;

a piston rod connected the piston and projecting upwardly from the piston and out from the draw tube;

a valve in said draw tube adapted to close when the piston moves downwardly into the draw tube, and to open when the piston moves upwardly in the draw tube; and a mounting cap for the pump adapted to connect to a neck of a first container of a first size, and also connect to a neck of a second container of a second, larger size;

said mounting cap having a top wall, an inner cylindrical wall extending axially downwardly from the top wall, and an outer cylindrical wall extending axially downwardly from the top wall concentrically outwardly of the inner cylindrical wall;

said inner cylindrical wall having internal threads for connecting the cap to the external threads on the neck of the first container, with the draw tube extending downwardly into the first container;

said second cylindrical wall having internal threads for connecting the cap to external threads on the neck of the second, larger container, with the draw tube extending downwardly into the second container; and said mounting cap being mounted on and rotatable about the draw tube and retained against up and down movement along the draw tube.

2. The pump of claim 1, wherein the top wall of the mounting cap includes a central opening and an upper end portion of the elongated draw tube extends upwardly through said opening, said draw tube including a radial flange on the draw tube positioned below the top wall of the mounting cap where it boarders the opening in the mounting cap, and a retainer above the mounting cap engaging the upper end portion of the draw tube, said retainer preventing upward movement of the mounting cap off the upper end of the draw tube.

3. The pump of claim 2, wherein the draw tube includes a piston chamber through which the piston moves as it slides up and down in the draw tube, and a flaring section at the upper end of the piston chamber that increases in diameter as it extends upwardly from the piston chamber to the upper end portion of the draw tube.

4. Then pump of claim 3, where in the radial flange extends radially outwardly from where the upper end of the flare portion meets the upper end portion of the draw tube.

5. The pump of claim 1, wherein the piston rod includes an outlet passageway for said pump, and said pump includes a depress button connected to an upper end portion of said piston rod.

6. The pump of claim 2, wherein the piston rod includes an outlet passageway for said pump, and said pump includes a depress button connected to an upper end portion of said piston rod.

7. The pump of claim 3, wherein the piston rod includes an outlet passageway for said pump, and said pump includes a depress button connected to an upper end portion of said piston rod.

8. The pump of claim 4, wherein the piston rod includes an outlet passageway for said pump, and said pump includes a depress button connected to an upper end portion of said piston rod.

9. The pump of claim 5, wherein the outlet passageway has a portion extending through the depress button, and said pump includes a discharge passageway reading laterally from the portion of the outlet passageway that is in the depress button.

* * * * *

UNITED STATES PATENT AND TRADEMARK OFFICE

CERTIFICATE OF CORRECTION

PATENT NO. : 7,857,172 B2
APPLICATION NO. : 12/157279
DATED : December 28, 2010
INVENTOR(S) : J. N. Harvey It is certified that error appears in the above-identified patent and that said Letters Patent is hereby corrected as shown below:

| COLUMN | LINE | ERROR |
|---|---|---|
| 4 (Claim 1, line 6) | 17 | "a piston rod connected the piston" should read --a piston rod connected to the piston-- |
| 4 (Claim 4, line 1) | 56 | "Then pump" should read --The pump-- |
| 4 (Claim 4, line 1) | 56 | "where in the radial flange" should read --wherein the radial flange-- |

Signed and Sealed this
Nineteenth Day of April, 2011

David J. Kappos

David J. Kappos
*Director of the United States Patent and Trademark Office*